US008864233B2

(12) United States Patent
Wei et al.

(10) Patent No.: US 8,864,233 B2
(45) Date of Patent: Oct. 21, 2014

(54) TATTOO CHAIR

(76) Inventors: Wen Wei, Los Angeles, CA (US); Michael Chen, Los Angeles, CA (US); Billy Chen, Los Angeles, CA (US)

( * ) Notice: Subject to any disclaimer, the term of this patent is extended or adjusted under 35 U.S.C. 154(b) by 1210 days.

(21) Appl. No.: 12/739,882

(22) PCT Filed: Sep. 22, 2008

(86) PCT No.: PCT/CN2008/001636

§ 371 (c)(1),
(2), (4) Date: Jul. 25, 2011

(87) PCT Pub. No.: WO2009/056004

PCT Pub. Date: May 7, 2009

(65) Prior Publication Data

US 2011/0272976 A1 Nov. 10, 2011

(30) Foreign Application Priority Data

Oct. 31, 2007 (CN) ..... 2007 2 0195884 U

(51) Int. Cl.

| | |
|---|---|
| ***A61G 15/02*** | (2006.01) |
| ***A61G 15/12*** | (2006.01) |
| ***A47C 1/06*** | (2006.01) |
| ***A47C 7/38*** | (2006.01) |
| ***A47C 1/022*** | (2006.01) |
| ***A47C 15/00*** | (2006.01) |
| ***A47C 7/50*** | (2006.01) |
| ***A47C 7/54*** | (2006.01) |

(52) U.S. Cl.

CPC ..... *A47C 15/004* (2013.01); *A47C 7/38* (2013.01); *A61G 15/02* (2013.01); *A47C 1/022* (2013.01); *A47C 7/503* (2013.01); *A47C 7/546* (2013.01); *A47C 1/06* (2013.01)

USPC ..... 297/354.13; 297/195.11; 297/397; 297/423.4

(58) Field of Classification Search

USPC ..... 297/354.13, 366, 900, 195.11, 397, 297/377, 452.34, 452.35, 118, 354.11, 297/411.39, 423.4; 5/617

See application file for complete search history.

(56) References Cited

U.S. PATENT DOCUMENTS 165,498 A * 7/1875 Ott ..... 297/366
282,737 A * 8/1883 Liscomb ..... 297/358

(Continued)

FOREIGN PATENT DOCUMENTS

| | | |
|---|---|---|
| CN | 2151738 | 1/1994 |
| CN | 300792112 | 6/2008 |
| CN | 201119969 | 9/2008 |

OTHER PUBLICATIONS

International Search Report of PCT/CN2008/001636 dated Nov. 27, 2008.

*Primary Examiner* — Milton Nelson, Jr.
(74) *Attorney, Agent, or Firm* — Rankin, Hill & Clark LLP

(57) ABSTRACT

A tattoo chair includes a backrest, a seat, a brace for supporting the seat, and a base for allowing the chair to stand stably. The lower end of the backrest is rotatably attached to the inner side of the seat. A supporting fixed plate is provided under the bottom surface of the seat. At least one fixed gear rack is mounted from top to bottom on the rear surface of the backrest. A supporting rod is provided on the supporting fixed plate. One end of the supporting rod is rotatably attached to the supporting fixed plate, and the other end is put into one of grooves of the gear rack on the rear surface of the backrest.

23 Claims, 6 Drawing Sheets

(56) References Cited

U.S. PATENT DOCUMENTS

| | | | | | |
|---|---|---|---|---|---|
| 454,100 | A | * | 6/1891 | Wilson | 297/411.4 |
| 717,026 | A | | 12/1902 | Ostendorf | |
| 1,699,894 | A | | 1/1929 | Klemm | |
| 1,941,340 | A | | 12/1933 | Dellert | |
| 2,364,050 | A | | 12/1944 | Benson | |
| 2,562,339 | A | * | 7/1951 | Socol | 5/617 |
| 3,220,771 | A | | 11/1965 | Doss, Sr. | |
| 3,264,382 | A | * | 8/1966 | Angell et al. | 264/46.4 |
| 3,837,705 | A | * | 9/1974 | Marraccini | 297/353 |
| 3,897,102 | A | | 7/1975 | Lemaire | |
| 4,607,882 | A | * | 8/1986 | Opsvik | 297/195.11 |
| 4,793,655 | A | * | 12/1988 | Kvalheim et al. | 297/423.13 |
| 4,832,407 | A | * | 5/1989 | Serber | 297/423.12 |
| 5,177,823 | A | * | 1/1993 | Riach | 5/636 |
| 5,232,426 | A | | 8/1993 | Van Straaten | |
| 5,350,346 | A | | 9/1994 | Martinez | |
| D352,635 | S | | 11/1994 | Yoder | |
| 5,538,011 | A | | 7/1996 | Craft et al. | |
| 5,875,779 | A | | 3/1999 | Fuhrman et al. | |
| 5,904,402 | A | * | 5/1999 | Sabo | 297/354.13 |
| 5,926,871 | A | | 7/1999 | Howard | |
| 6,012,184 | A | | 1/2000 | Childers | |
| 6,698,431 | B1 | | 3/2004 | Harris et al. | |
| 6,805,409 | B2 | * | 10/2004 | Parker | 297/377 |
| 6,854,807 | B2 | | 2/2005 | D'Alessandro | |
| 7,234,768 | B2 | | 6/2007 | Manning | |
| 7,618,090 | B2 | | 11/2009 | Grenon | |
| 7,770,976 | B2 | | 8/2010 | Lee | |
| 2002/0079731 | A1 | * | 6/2002 | Sisti | 297/397 |
| 2005/0264050 | A1 | * | 12/2005 | Richardson et al. | 297/195.11 |
| 2007/0052275 | A1 | * | 3/2007 | Ghilzai | 297/423.12 |
| 2012/0056453 | A1 | * | 3/2012 | Andoloro | 297/195.11 |

* cited by examiner

TATTOO CHAIR

TECHNICAL FIELD

The present invention generally relates to the field of chairs, and more particularly, the invention relates to a tattoo chair.

BACKGROUND

A tattoo chair is for a person who is getting tattoos to sit on. The existing tattoo chairs often comprise of a backrest, a seat, armrests, a brace and a base. Neighboring sides of the backrest and the seat are fixedly and vertically connected so that the seated person may lean against the backrest. The armrests are fixed on both sides of the seat for supporting the arms and improving the comfort. The brace is set between the seat and the base, and the seat stably stands on the ground through the brace. The obvious drawback with such known solutions is that height of the brace is not adjustable, which brings inconveniences in use. Consequently, chairs with height adjustable braces for providing different heights have already been available on the market.

The existing height adjustable tattoo chairs allow a person getting tattoos to sit right toward his front. That's to say, it's convenient to tattoo the shoulder of the person, but quite inconvenient to tattoo other regularly tattooed parts of the body, such as back, belly, waist and leg, etc. Furthermore, both tattoo artist and the person getting tattoos feel tired when tattooing in such an inconvenient situation. Therefore, there is a need to provide a tattoo chair making it convenient to tattoo regular tattooed parts of body, and making the person getting tattoos feel comfortable while being tattooed.

SUMMARY

According to one aspect, a tattoo chair is provided for facilitating the person getting tattoos to adopt different poses, so that the tattoo artist can work more easily; furthermore, when getting tattoos in various poses, the person will feel free and at ease without any discomfort.

According to the same or another aspect, a tattoo chair comprising a backrest, a seat, a brace for supporting the seat, and a base for allowing the chair to stand stably, wherein the lower end of the backrest is rotatably attached to the inner side of the seat; a supporting fixed plate is provided under the bottom surface of the seat to avoid direct interaction between the brace and seat and improve wear-resistance of the seat; at least one fixed gear rack is mounted from top to bottom on the rear surface of the backrest; a supporting rod is provided on the supporting fixed plate; one end of the supporting rod is rotatably attached to the supporting fixed plate, the other end is put into the groove of the gear rack on rear surface of the backrest; when the supporting rod is taken out of the groove of the fixed gear rack, the whole backrest can rotate around the seat; by positioning the supporting rod into different grooves of the fixed gear rack, inclination of the backrest can be adjusted; as the supporting rod is completely released, the backrest can rotate to be flush with the seat.

Further, according to the same or another aspect, in order to prevent the supporting rod from unexpectedly falling out of the groove of the fixed gear rack, a spring is provided between the lower part of inner side of the seat and the supporting rod.

Further, according to the same or another aspect, the brace is a hydraulic lifting device with its height adjusted via a pedal; the supporting fixed plate can rotate 360 degrees around the axis of the hydraulic lifting device. This configuration facilitates the person getting tattoos to bestride the tattoo chair, and it is convenient to tattoo the upper part of the person's back by lowering the height of the brace and tattoo the waist by raising the height of the brace.

According to the same or another aspect, the armrests are provided on left, right, or both sides of the seat and the backrest. Snap spring holes are provided in the seat and the backrest; fixing axes are provided on sides of both ends of the armrests to match the snap spring holes. Grooves for positioning are provided on the fixing axes to match the snap springs in the snap spring holes; thus, the fixing axes can be inserted into or taken out of the snap spring holes; this structure makes the person with his/her arms getting tattoos feel more comfortable.

According to the same or another aspect, a headrest is provided on top of the backrest; a fixing axis with grooves is provided at bottom of the headrest; a snap spring hole is provided on the upper surface of the backrest to match the fixing axis such that the headrest can be either mounted on or taken away from the backrest, and the headrest is more applicable for a tall person getting tattoos.

According to the same or another aspect, an arc hole is provided in the center of the headrest for the person getting tattoos to locate his/her face in it when he/she faces right toward the headrest.

According to the same or another aspect, a cushion is provided on the surface of the headrest, and the cushion is connected with the headrest through a hook and loop fastener (e.g., Velcro tape) so that the cushion can be mounted and detached easily; the cushion makes the person getting tattoos feel more comfortable when leaning his/her head against the cushion.

According to the same or another aspect, a leg rest is provided in the front of the seat, and the leg rest is rotatably attached to the seat. Leg rest supporting rods are provided on the rear surface of the leg rest, and a leg rest fixing brace is provided on the supporting fixed plate under the seat. The leg rest supporting rods are movably connected with the leg rest fixing brace. By adjusting the position of the leg rest supporting rods on the leg rest fixing brace, the inclination of the leg rest can be changed. The leg rest of the present utility model may be adjusted from horizontal position to vertical position. This configuration makes it quite convenient to tattoo the leg of the person getting tattoos.

According to the same or another aspect, the leg rest is a symmetrically separate structure comprising a left leg rest and a right leg rest each having a leg rest supporting rod; a left and a right leg rest fixing braces are mounted on the supporting fixed plate to match the left and the right leg rest supporting rods respectively. The separate structure allows adjusting the left and right leg rests respectively. This configuration allows for adjusting the position of each leg of the person getting tattoos when he/she is sitting right toward the front or lying on one's back, if needed.

According to the same or another aspect, a position-matched leg rest extension is provided on the lower end of the leg rest, where a snap spring holes are provided. Fixing axes with grooves are provided on the side of the leg rest extension connected to the leg rest. The fixing axes can be inserted into the snap spring holes in the lower end of the leg rest so as to connect the leg rest extension to the leg rest. The fixing axes on the leg rest extension can also be pulled out of the snap spring holes to take the leg rest extension away from the leg rest. This extension structure is more applicable for a tall person having long legs to get tattoos.

A tattoo chair according to one or more of the foregoing aspects allows the person getting tattoos to adopt different poses so that the tattoo artist can work more easily. Further, when getting tattoos, the person will feel free and at ease without any discomfort in various poses.

DETAILED DESCRIPTION OF EMBODIMENTS

Embodiment 1

Figure 1:
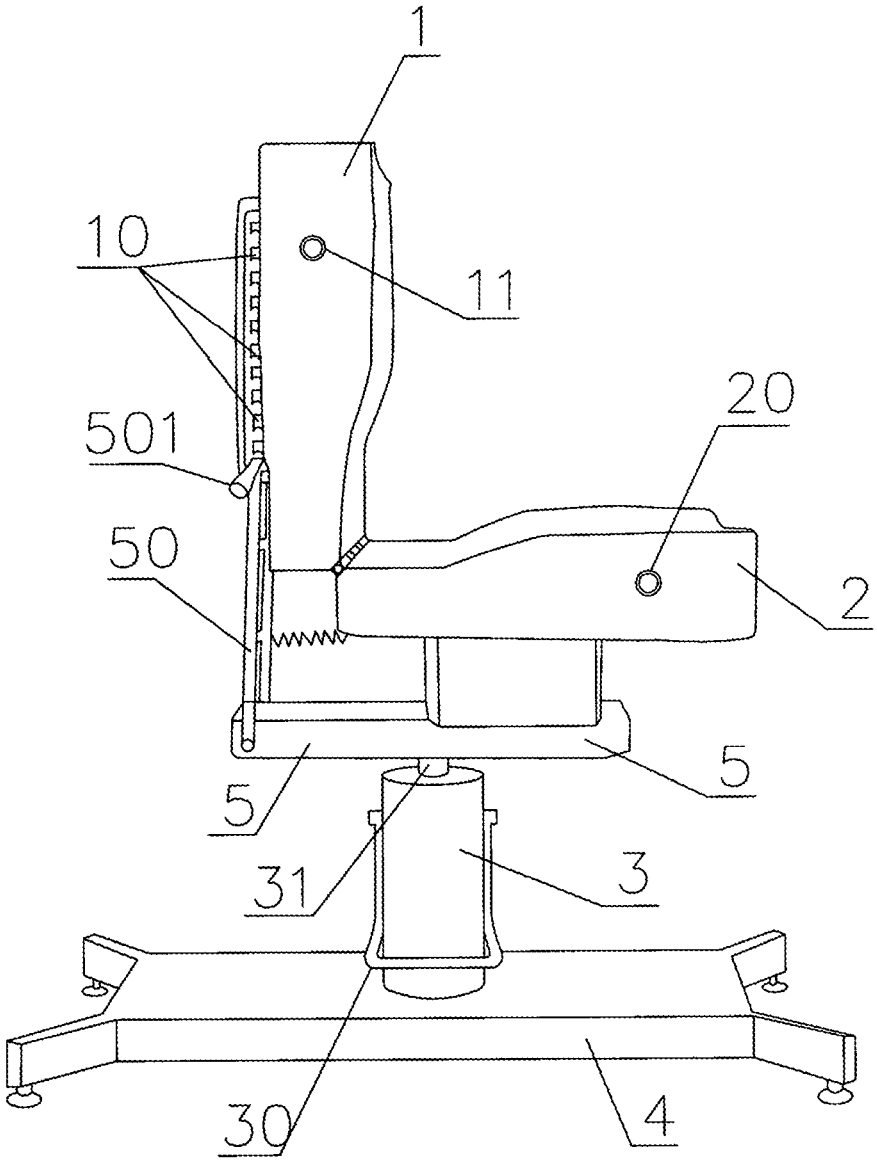
FIG. 1 is a side perspective view of the structure according to one exemplary embodiment.
Figure 2:
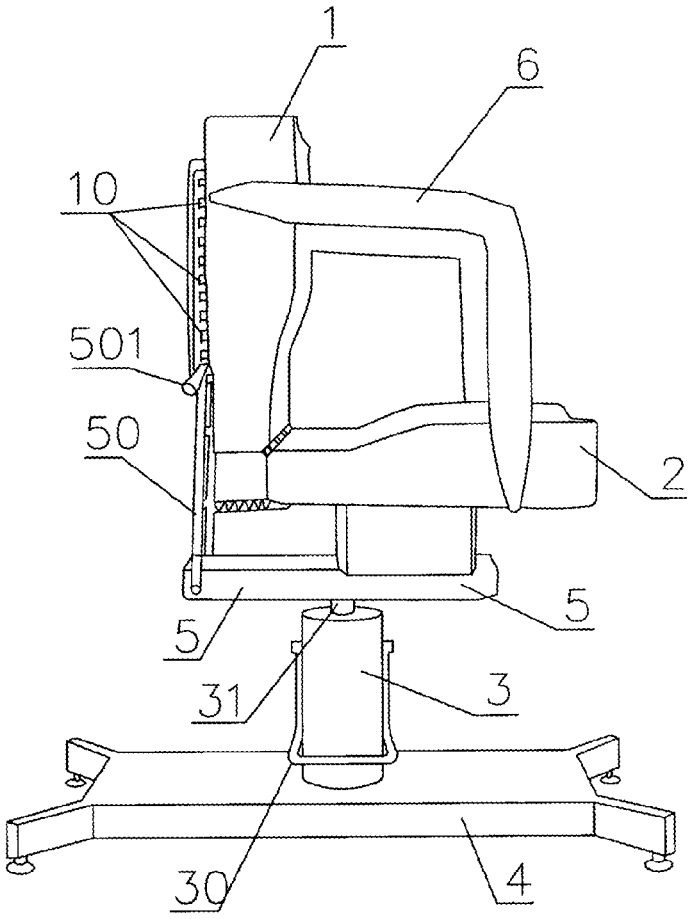
FIG. 2 is a side perspective view of the structure according to another exemplary embodiment.
Figure 3:
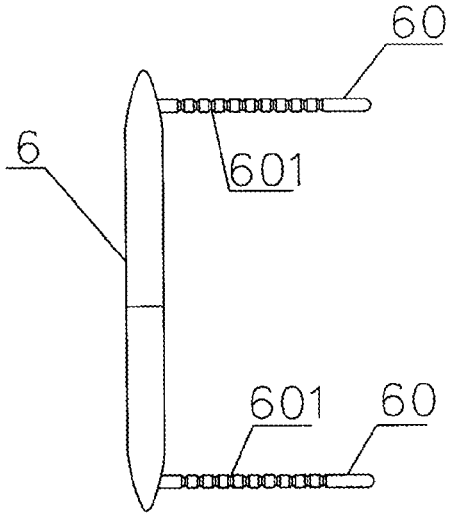
FIG. 3 is a front view of the armrest.
Figure 4:
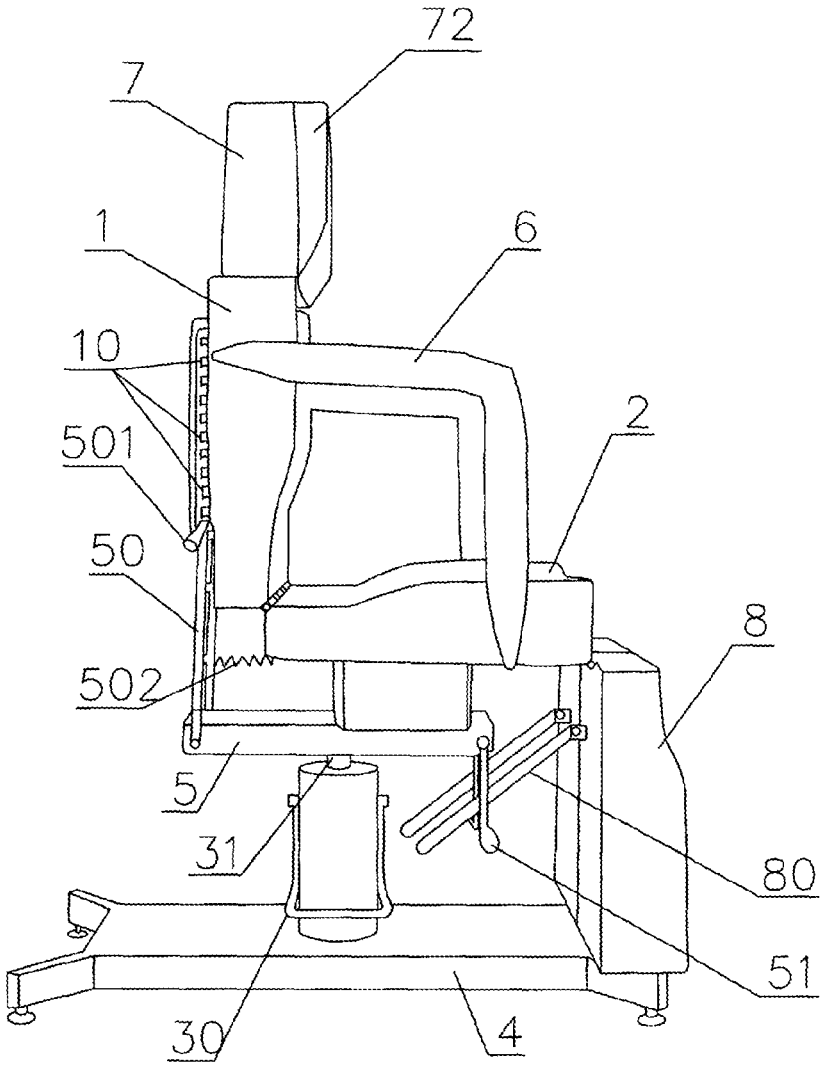
FIG. 4 is a side perspective view of the structure according to still another exemplary embodiment.

Referring to FIGS. 1, 2, 4, 6, 7 and 8, a tattoo chair comprises the backrest 1, seat 2, brace 3 for supporting the seat 2, and base 4 for allowing the chair to stand stably.

The inner side of the lower end of the backrest 1 is rotatably attached to the inner side of the seat 2 through a hinge. The seat 2 is fixed, and the backrest 1 can rotate around the inner side of the seat 2. The backrest 1 can rotate anticlockwise 90 degrees at most, that is, the backrest 1 can at lowest be flush with the seat 2. A supporting fixed plate 5 is provided under the bottom surface of the seat 2 to avoid direct contact between the brace 3 and seat 2 and improve the wear-resistance of the seat 2. A fixed gear rack 10 is mounted from top to bottom on the rear surface of the backrest 1, and one or more the racks may be mounted in longitudinal direction; a supporting rod 50, for example in all-shape, is attached to the supporting fixed plate 5; the left and right lower ends of the supporting rod 50 are rotatably attached to the supporting fixed plate 5, while the upper cross rod 501 is put into the groove of the gear rack 10 on the rear surface of the backrest 1. When the cross rod 501 of the supporting rod 50 is taken out of the groove of the fixed gear rack 10, the whole backrest 1 can rotate around the seat 2. By positioning the cross rod 501 of the supporting rod 50 on the fixed gear rack 10, the inclination of backrest 1 can be adjusted. As the supporting rod 50 is completely released, the backrest 1 can rotate to be flush with the seat 2.

Referring to FIGS. 1, 2, 4 and 8, further, in order to prevent the supporting rod 50 from unexpectedly falling out of the groove of the fixed gear rack 10, a spring 502 is provided between the lower part of inner side of the seat 2 and middle part of the supporting rod 50.

Referring to FIGS. 1, 2, 4, 6, 7 and 8, further, the brace 3 is a hydraulic lifting device with its height adjusted via a pedal 30. The supporting fixed plate 5 can rotate 360 degrees around the axis 31 of the hydraulic lifting device 3. This configuration facilitates the person getting tattoos to bestride the tattoo chair. The upper part of a person's back can be tattooed conveniently by lowering the height of the brace 3, and the waist of a person can be tattooed conveniently by raising the height of the brace 3.

Referring to FIGS. 2, 3, 4, 6, 7 and 8, in accordance with the further improved embodiment, armrests 6 are provided on the left, right, or both sides of the seat 2 and backrest 1. Snap spring holes 20, 11 are provided in the seat 2 and backrest 1. Fixing axes 60 are provided on the side of both ends of the armrests 6 to match the snap spring holes 20, 11, and grooves 601 for positioning are provided on the fixing axes 60 to match the snap springs in the snap spring holes 20, 11 so that the fixing axes 60 can be inserted into or taken out of the snap spring holes 20, 11. This configuration makes the person getting tattoos on his/her arms feel more comfortable.

Referring to FIGS. 4, 5, 6, 7 and 8, in accordance with the further improved embodiment, an easily mounted and detached headrest 7 is provided on the top of the backrest 1. A fixing axis 70 with grooves 701 is provided at the bottom of the headrest 7. A snap spring hole (not shown) is provided on the upper surface of the backrest 1 to match the fixing axis 70. Thus, the headrest 7 can be either mounted onto or taken away from the backrest 1. The headrest 7 is more applicable for a tall person getting tattoos.

Figure 5:
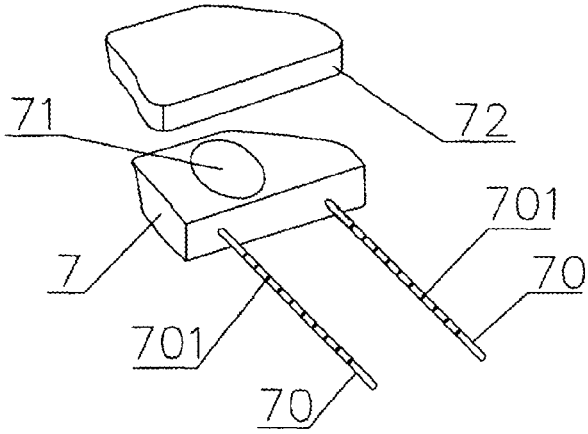
FIG. 5 is a perspective view of the structure of the headrest.

Referring to FIG. 5, in accordance with the further improved embodiment, an arc hole 71, preferably having a shape matching a face, is provided in the center of the headrest 7 for the person getting tattoos to locate his/her face when bestriding the tattoo chair.

Referring to FIGS. 4, 5, 6, 7 and 8, in accordance with the further improved embodiment, a cushion 72 is provided on the surface of the headrest 7, and the cushion 72 is connected with the headrest 7 through a hook and loop fastener (e.g., Velcro tape) so that the cushion can be mounted and detached easily. The cushion 72 makes the person getting tattoos feel more comfortable when his/her head leans against the cushion.

Referring to FIGS. 4, 6, 7 and 8, in accordance with the further improved embodiment, a leg rest 8 is provided in the front of the seat 2. The leg rest 8 is rotatably attached to the seat 2 through hinges. While the seat 2 is fixed, the leg rest 8 can rotate around the seat 2 clockwise from horizontal position. Leg rest supporting rods 80 are provided on the rear surface of the leg rest 8. A leg rest fixing brace 51 is mounted on the supporting fixed plate 5 under the seat 2. The leg rest supporting rods 80 are movably connected with the leg rest fixing brace 51. By adjusting the position of the leg rest supporting rods 80 with regard to the leg rest fixing brace 51, the inclination of the leg rest 8 with regard to the horizontal plane can be adjusted. The leg rest 8 can rotate around the seat 2 from horizontal position to vertical position. This configuration makes it quite convenient to tattoo the leg of the person.

Figure 7:
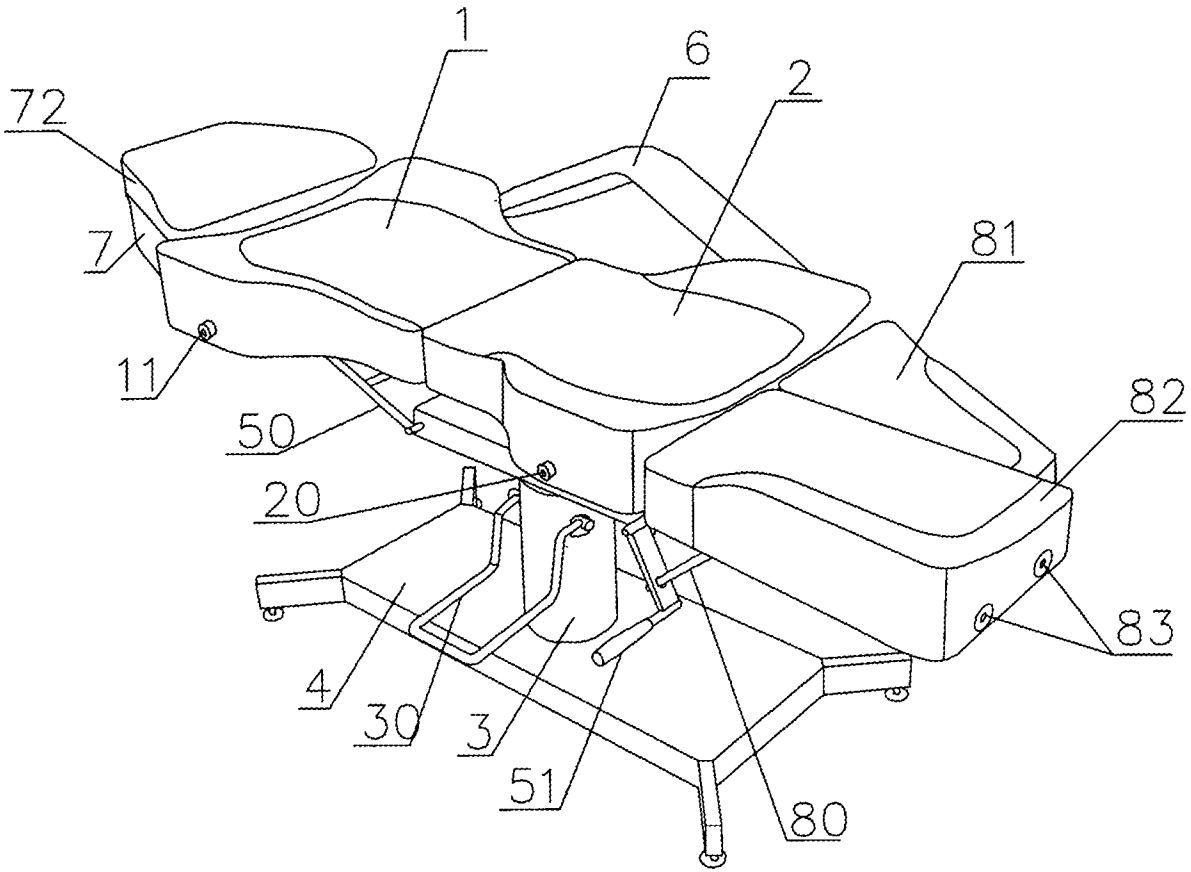
FIG. 7 is a perspective view of the state in use according to a specific exemplary embodiment.

Referring to FIG. 7, in accordance with the further improved embodiment, the leg rest 8 is a symmetrically separate structure comprising a left leg rest 81 and a right leg rest 82, each having a leg rest supporting rod 80. The left and the right leg rest fixing braces 51 are mounted on the supporting fixed plate 5 to match the supporting rods 80 of the left and right leg rests 81, 82, respectively. The separate structure allows adjusting the left and the right leg rests 81, 82 respectively. This configuration allows for adjusting the position of each leg of the person getting tattoos, if needed, when he/she is sitting or lying on his/her back.

Figure 6:
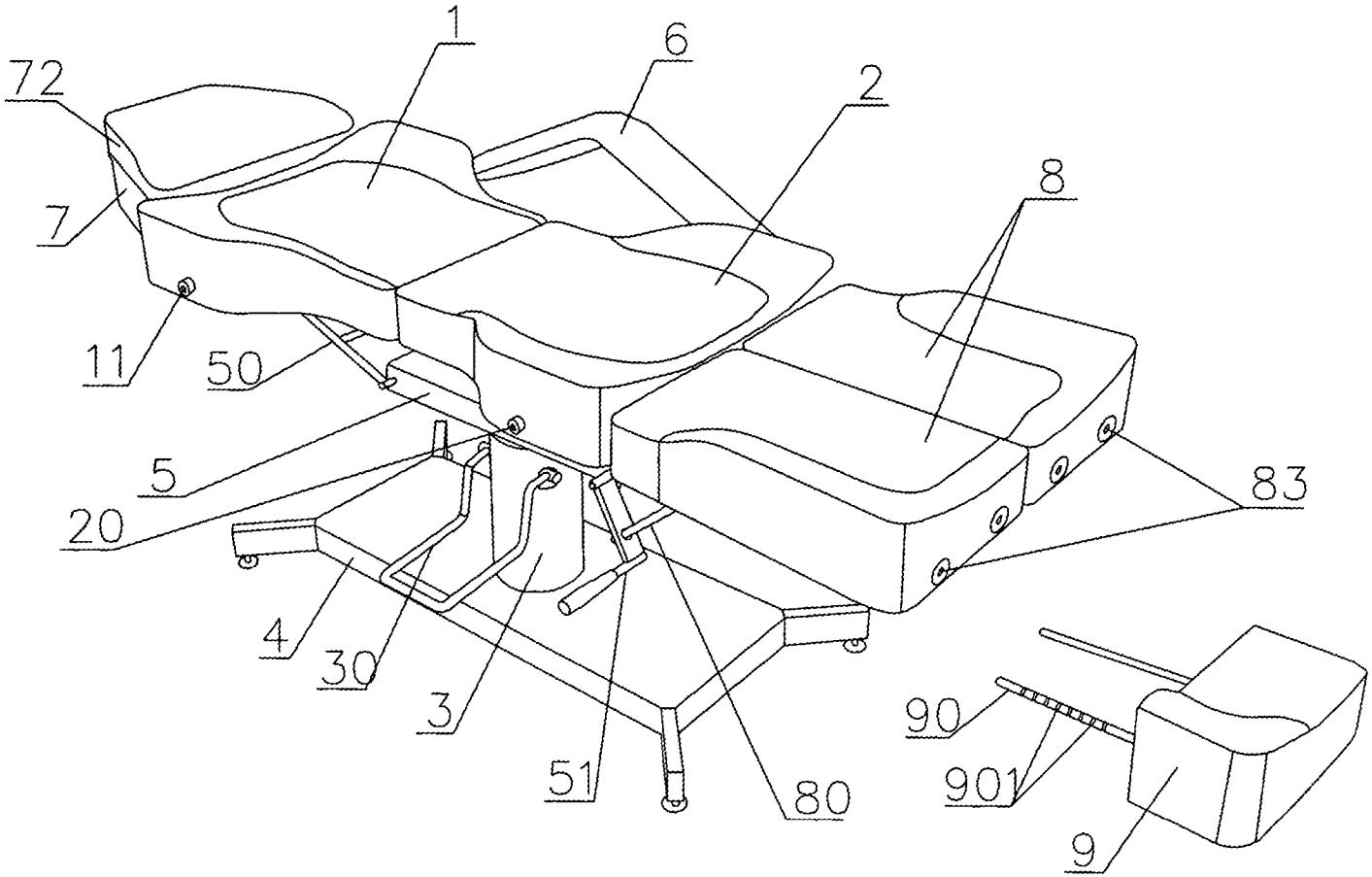
FIG. 6 is a perspective view of the structure according to yet another specific exemplary embodiment.
Figure 8:
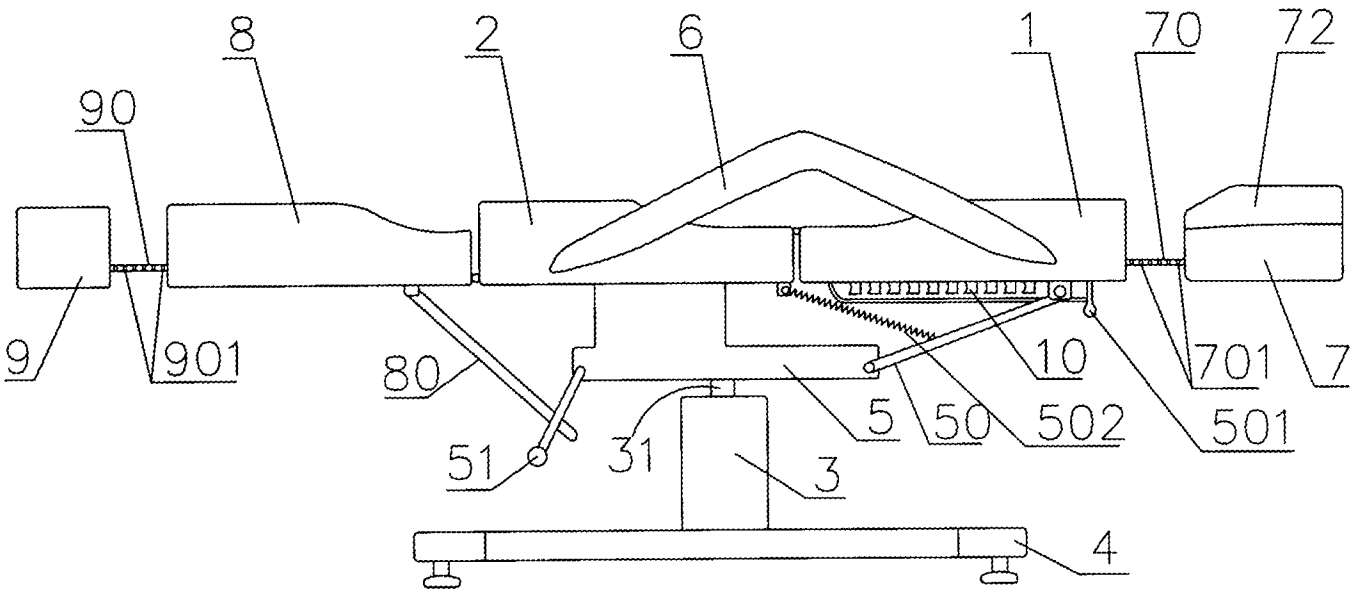
FIG. 8 is a perspective view of the structure according to a specific exemplary embodiment.

Referring to FIGS. 6 and 8, in accordance with the further improved embodiment, a position-matched leg rest extension 9 is provided on the lower end of the leg rest 8, where snap spring holes 83 are provided. Fixing axes 90 with grooves 901 are provided on the side of the leg rest extension 9 connected to the leg rest 8. The fixing axes 90 can be inserted into the snap spring holes 83 in the lower end of the leg rest 8 to connect the leg rest extension 9 to the leg rest 8. The fixing axes 90 on the leg rest extension 9 can also be pulled out of the snap spring holes 83 to take the leg rest extension 9 away from the leg rest 8. This extension structure is more applicable for a tall person having long legs to get tattoos.

Obviously, the embodiments described above are provided for purpose of clear explanation but not for limiting the same. In fact, it will be appreciated to those skilled in the art that various modifications and variations may be made without departing from the spirit or scope of the invention. Accordingly, any apparent alteration or modification derived from the described exemplary embodiments will be in the scope of protection of the present invention.

The invention claimed is:

1. A tattoo chair, comprises a backrest, a seat, a brace for supporting said seat, and a base for allowing the chair to stand stably, wherein a lower end of said backrest is rotatably attached to an inner side of said seat; a supporting fixed plate is provided under a bottom surface of said seat; at least one fixed gear rack is mounted from top to bottom on a rear surface of said backrest; a supporting rod is provided on said supporting fixed plate; one end of said supporting rod is rotatably attached to said supporting fixed plate, and the other end is put into one of grooves of said at least one fixed gear rack on the rear surface of said backrest.

2. A tattoo chair of claim 1, wherein armrests are provided on the left, right, or both sides of said seat and backrest; snap spring holes are provided in said seat and backrest; fixing axes are provided on sides of both ends of said armrests to match the snap spring holes, and grooves for positioning are provided on the fixing axes to match the snap springs in the snap spring holes.

3. A tattoo chair of claim 1, wherein said brace is a hydraulic lifting device with its height adjusted via a pedal, and said supporting fixed plate is rotatable 360 degrees around an axis of the hydraulic lifting device.

4. A tattoo chair of claim 1 wherein the backrest includes a narrowed section adjacent the seat to enable a person supported by the tattoo chair to straddle the tattoo chair and face toward the backrest.

5. A tattoo chair of claim 4 wherein the seat includes a narrowed section adjacent the seatback to further enable a person supported by the tattoo chair to straddle the tattoo chair and face toward the backrest.

6. A tattoo chair of claim 1, wherein a leg rest is provided in a front of said seat, and said leg rest is rotatably attached to the seat; leg rest supporting rods are provided on a rear surface of said leg rest, and a leg rest fixing brace is provided on the supporting fixed plate under said seat; the leg rest supporting rods are movably connected with the leg rest fixing brace.

7. A tattoo chair of claim 6, wherein said leg rest is a symmetrically separate structure comprising a left part and a right part each having a leg rest supporting rod; and the leg rest fixing brace includes left and right leg rest fixing braces portions provided on said supporting fixed plate to match left and right ones of the leg rest supporting rods.

8. A tattoo chair of claim 7, wherein a position-matched leg rest extension is provided on a lower end of said leg rest, where snap spring holes are provided; fixing axes with grooves are provided on a side of said leg rest extension connected to the leg rest; the fixing axes are removably inserted into the snap spring holes in the lower end of the leg rest, to removably connect the leg rest extension to the leg rest.

9. A tattoo chair of claim 1, wherein a spring extends between a lower part of the inner side of said seat and the supporting rod.

10. A tattoo chair of claim 9, wherein a leg rest is rotatably attached to the seat; said leg rest is a symmetrically separate structure comprising a left part and a right part and wherein a position-matched leg rest extension is removably disposed on a lower end of said leg rest.

11. A tattoo chair of claim 9, wherein armrests are provided on the left, right, or both sides of said seat and backrest; snap spring holes are provided in said seat and backrest; fixing axes are provided on sides of both ends of said armrests to match the snap spring holes, and grooves for positioning are provided on the fixing axes to match the snap springs in the snap spring holes.

12. A tattoo chair of claim 9, wherein a headrest is adjustably mounted on the top of said backrest.

13. A tattoo chair of claim 1, wherein a headrest is removably mounted on a top of said backrest; a fixing axis with grooves is provided at a bottom of said headrest; a snap spring hole is provided on an upper surface of said backrest to match the fixing axis.

14. A tattoo chair of claim 13, wherein an arc hole is provided in a center of said headrest.

15. A tattoo chair of claim 14, wherein a cushion is provided on a surface of said headrest, and said cushion is removably connected with the headrest.

16. A tattoo chair of claim 15 wherein the backrest includes an upper portion and a lower portion adjacent the seat, the lower portion has a reduced lateral width relative to the upper portion for facilitating straddling the tattoo chair and facing toward the backrest.

17. An adjustable tattoo chair, comprising:

a seat base supported in an elevated position;

a seat back extending from the seat base and pivotally movable relative to the seat base between an upright position and a generally horizontal position, wherein at least one of the seat base and the seat back includes a narrowed portion adjacent the other of said at least one of the seat base and the seat back for facilitating straddling of the tattoo chair;

a rack gear mounted orthogonally relative to an intersection axis between the seat base and the seat back; and a pivotally mounted member pivotally connected to the seat base and having a free end configured to engage the rack gear for securing the seat back at a desired angle of inclination relative to the seat base, the pivotally mounted member being biased toward the seat back.

18. The adjustable tattoo chair of claim 17 wherein the seat base includes the narrowed portion.

19. The adjustable tattoo chair of claim 17 further including a headrest removably connected to the seat back, the headrest including a main body having a face recess defined therein and a pillow cover removably secured to the main body for selectively covering the face recess.

20. The adjustable tattoo chair of claim 17 wherein the seat back includes the narrowed portion.

21. The adjustable tattoo chair of claim 20 wherein the seat back includes raised bolster portions disposed along lateral sides of the seat back.

22. An adjustable tattoo chair, comprising:

a seat base supported in an elevated position;

a seat back extending from the seat base and pivotally movable relative to the seat base between an upright position and a generally horizontal position;

a rack gear mounted vertically to the seat back;

a supporting rod having a proximal end pivotally connected to the seat base and a free end configured to removably engage the rack gear at a select gear location along the rack gear for securing the seat back at a desired angle of inclination relative to the seat base;

a brace for supporting the seat base, the seat base being rotatable around an axis defined by the brace; and a support member depending from an underside of the seat base, the support member defining a pivot location at which the supporting rod is pivotally mounted, the pivot location spaced apart from the underside of the seat base.

23. The adjustable tattoo chair of claim 22 wherein the seat back includes a narrowed section adjacent the seat base to enable a person supported by the tattoo chair to straddle the tattoo chair and face toward the seat back.

* * * * *